US007216762B2

(12) United States Patent
Chen

(10) Patent No.: US 7,216,762 B2
(45) Date of Patent: May 15, 2007

(54) HEAD FRAME FOR CLUB-BAGGING DEVICE

(75) Inventor: Changfu Chen, Taipei (TW)

(73) Assignee: Chenterlun Inc, Taichung (TW)

( * ) Notice: Subject to any disclaimer, the term of this patent is extended or adjusted under 35 U.S.C. 154(b) by 424 days.

(21) Appl. No.: 10/700,608

(22) Filed: Nov. 3, 2003

(65) Prior Publication Data

US 2005/0092630 A1 May 5, 2005

(51) Int. Cl.
*A63B 55/04* (2006.01)
*A63B 55/00* (2006.01)

(52) U.S. Cl. ..... 206/315.6; 206/315.3; 206/315.5; 383/12

(58) Field of Classification Search ..... 206/315.6, 206/315.3, 315.4, 315.7; 383/12
See application file for complete search history.

(56) References Cited

U.S. PATENT DOCUMENTS 1,868,979 A * 7/1932 Hotze ..... 224/613
1,951,158 A * 3/1934 Locke et al. ..... 206/315.5
2,256,521 A * 9/1941 Kirkpatrick et al. ..... 206/315.3
5,102,529 A * 4/1992 Hickin ..... 206/315.3
5,458,240 A * 10/1995 Rich et al. ..... 206/315.3
5,816,397 A * 10/1998 Pratt ..... 206/315.6
6,199,690 B1 * 3/2001 Shin ..... 206/315.3
6,386,362 B1 * 5/2002 Cheng ..... 206/315.3
6,450,334 B1 * 9/2002 Chang ..... 206/315.3
2004/0178093 A1 * 9/2004 Reimers ..... 206/315.3
2005/0061693 A1 * 3/2005 Chen ..... 206/315.7

* cited by examiner

*Primary Examiner*—Tri Mai
(74) *Attorney, Agent, or Firm*—Alan Kamrath; Kamrath & Associates PA

(57) ABSTRACT

A club-bagging device includes a bag, a head frame and at least one lug. The head frame is installed on the bag. The lug is formed on the head frame. A shoulder strap may be attached to the lug. Alternatively, a hook connected with a towel may be engaged with lug. Alternatively, tees may be held on the lug. Alternatively, a tie may be attached to the lug for binding an umbrella.

15 Claims, 6 Drawing Sheets

HEAD FRAME FOR CLUB-BAGGING DEVICE

FIELD OF INVENTION

The present invention relates to a club-bagging device including a bag and a head frame formed with a plurality of lugs for engagement with hooks.

BACKGROUND OF INVENTION

Referring to FIG. 6, a conventional club-bagging device includes a bag 1 and a head frame 2 installed on the bag 1. A shoulder strap 3 is sewn on the bag 1. A strap 4 is inserted through a ring 5. Two ends of the strap 4 are sewn on the bag 1. A hook 6 is sewn on a towel. The hook 6 can be engaged with the ring 5. Thus, the towel is attached to the bag 1. Two ends of a strap 7 are sewn on the bag 1. Thus, a loop is formed by the strap 7. A tie 8 is inserted through the loop formed by the strap 7. A locking element 9 is installed on the tie 8. The tie 8 and the locking element 9 are used to hold an umbrella for example. However, the sewing of the straps 3, 4 and 7 on the bag 1 is troublesome and provides inadequate strength.

The present invention is therefore intended to obviate or at least alleviate the problems encountered in the prior art.

SUMMARY OF INVENTION

It is the primary objective of this invention is to provide a club-bagging device including a bag and a head frame formed with a plurality of lugs for firmly holding a plurality of articles.

Other objectives, advantages and features of the present invention will become apparent from the following detailed description when taken in conjunction with the drawings.

DETAILED DESCRIPTION OF PREFERRED EMBODIMENT

Figure 1:
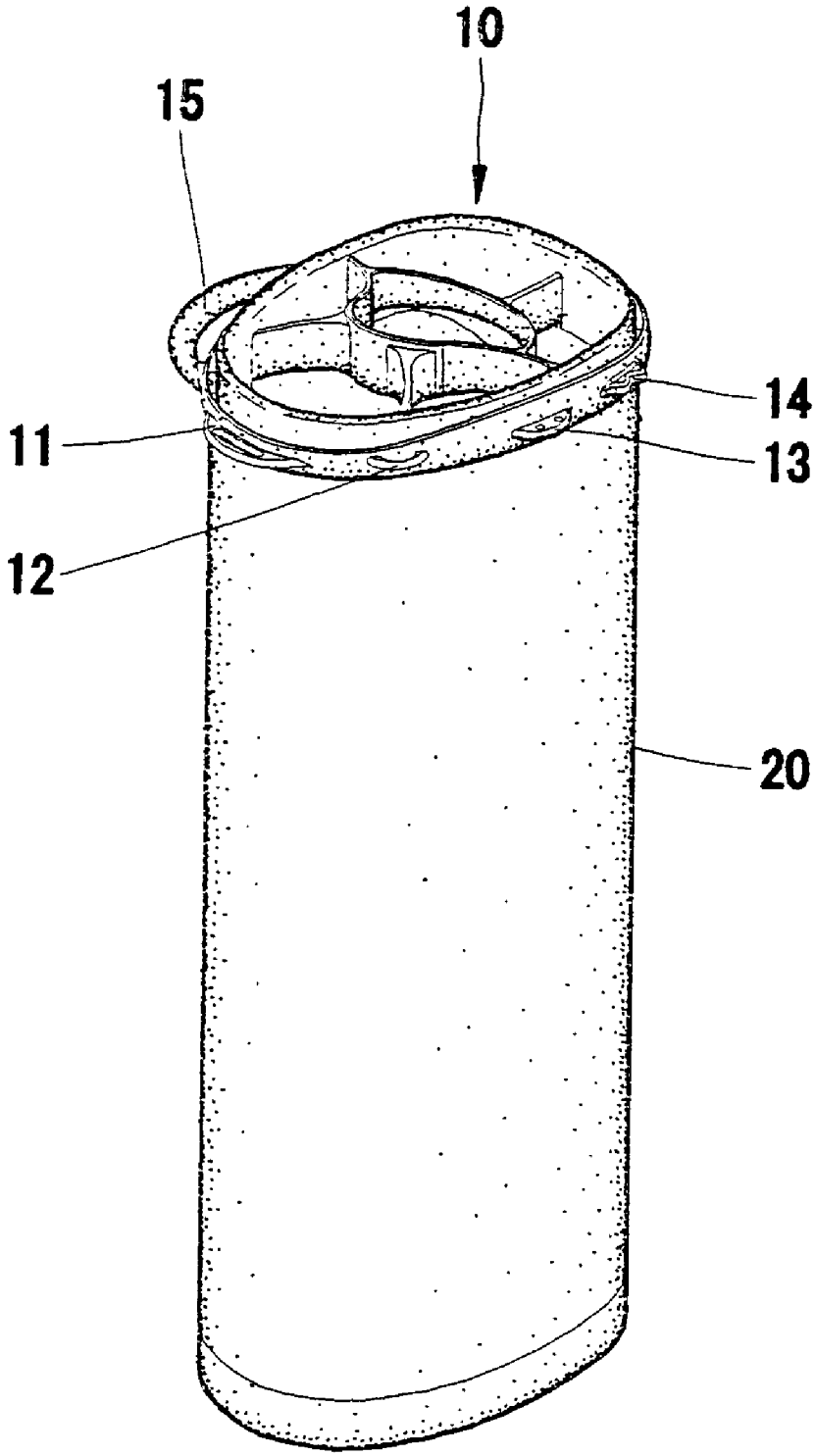
FIG. 1 is a perspective view of a club-bagging device according to the preferred embodiment of the present invention.
Figure 2:
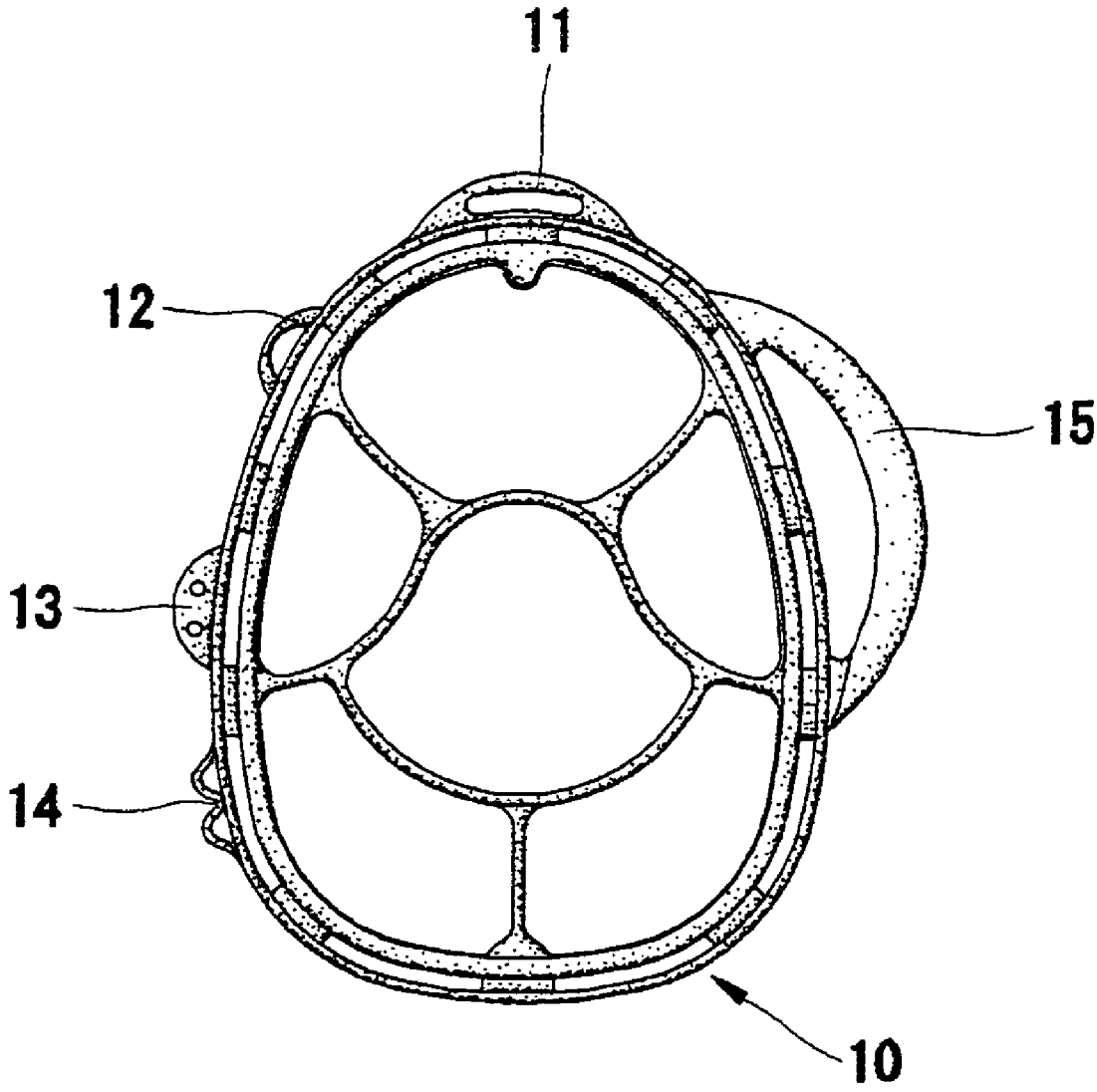
FIG. 2 is a top view of the club-bagging device of FIG. 1.

Referring to FIGS. 1 and 2, in accordance with the preferred embodiment of the present invention, a club-bagging device includes a head frame 10 and a bag 20 on which the head frame 10 is installed.

A first lug 11, a second lug 12, a third lug 13, a fourth lug 14 and a handle 15 are formed on the head frame 10 during molding of the head frame 10.

Figure 3:
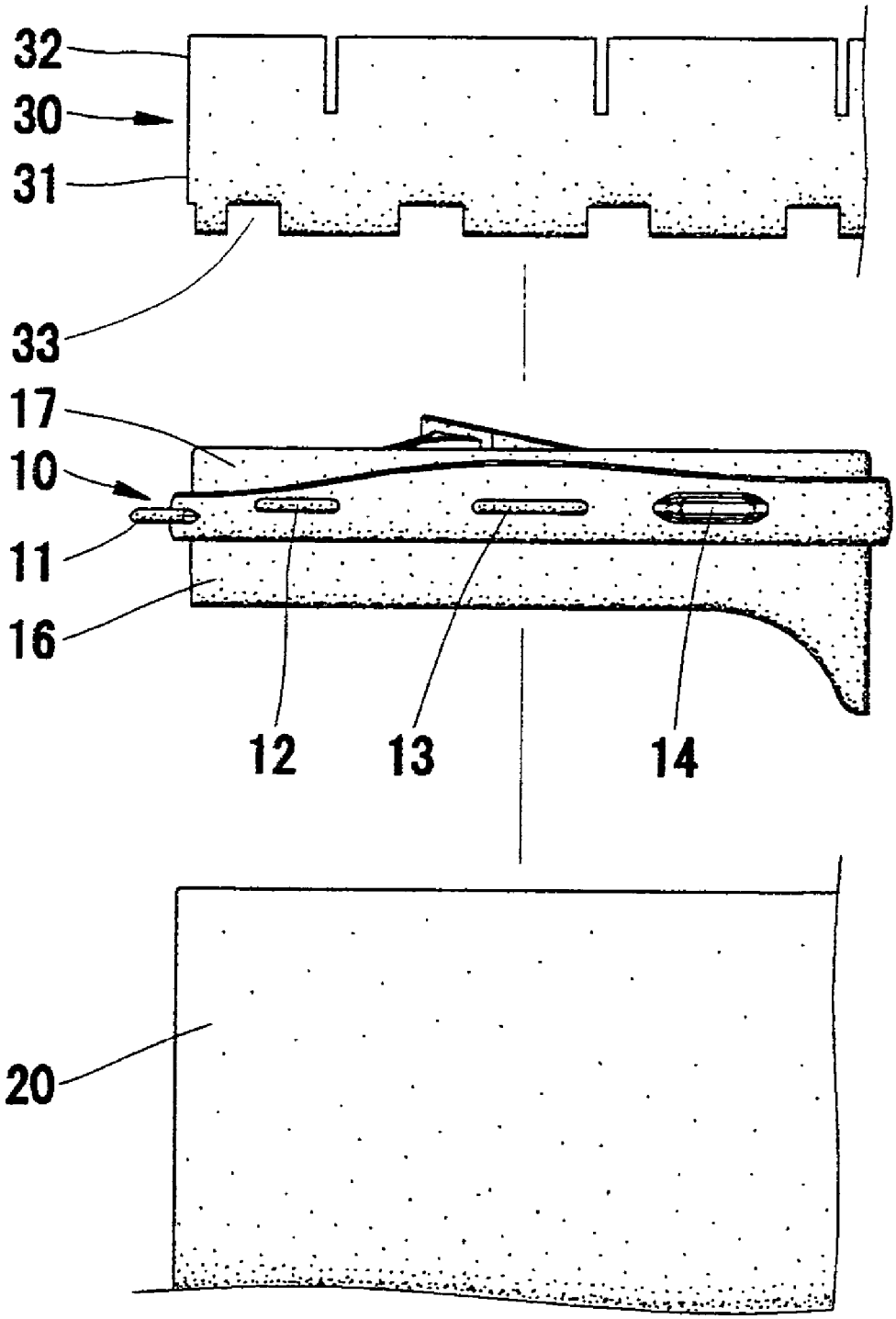
FIG. 3 is an exploded view of the club-bagging device of FIG. 1.

Referring to FIG. 3, the head frame 10 includes a lower portion 16 and an upper portion 17. The lower portion 16 of the head frame 10 is put in the bag 10. The lower portion 16 of the head frame 10 may be attached to the bag 10 by rivets (not shown). The lugs 11, 12, 13 and 14 and the handle 15 are formed on the upper portion 17 of the head frame 10. A cloth 30 is used to conceal the head frame 10. The cloth 30 includes a first portion 31 and a second portion 32. Several cutouts 33 are defined in the first portion 31 of the 30.

Figure 4:
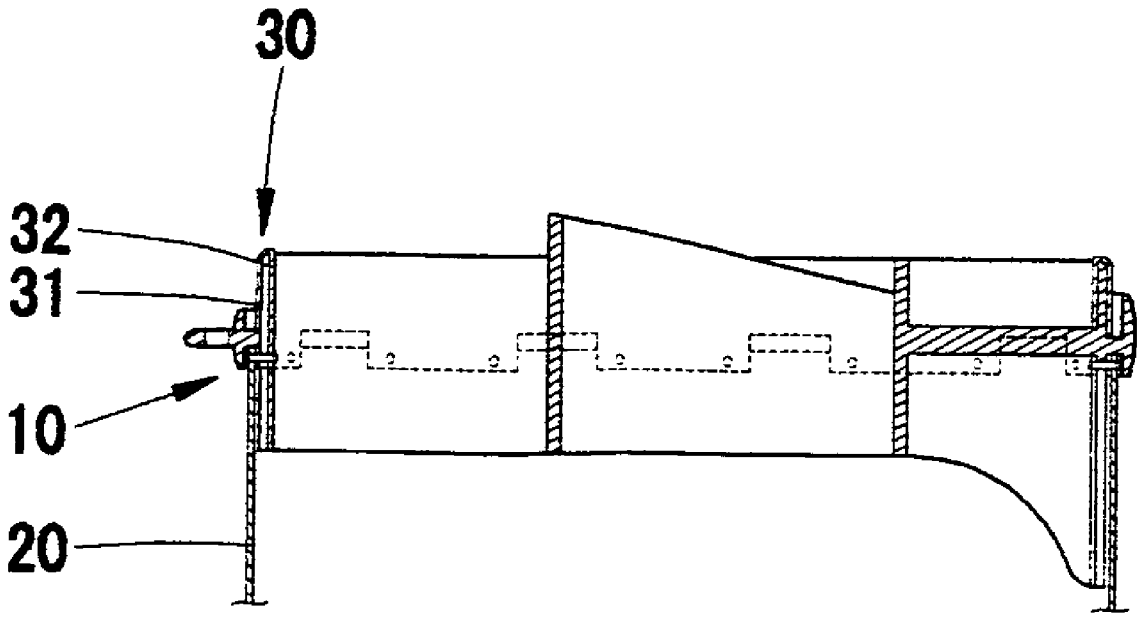
FIG. 4 is a cross-sectional view of the club-bagging device of FIG. 1.

Referring to FIG. 4, the cloth 30 is put on the head frame 10 so that the first portion 31 of the cloth 30 is located on an external side of the head frame 10 while the second portion 32 is located on an internal side of the head frame 10. The lugs 11, 12, 13 and 14 and the handle 15 are put in the cutouts 33. The cloth 30 may be attached to the head frame 10 by rivets (not numbered).

Figure 5:
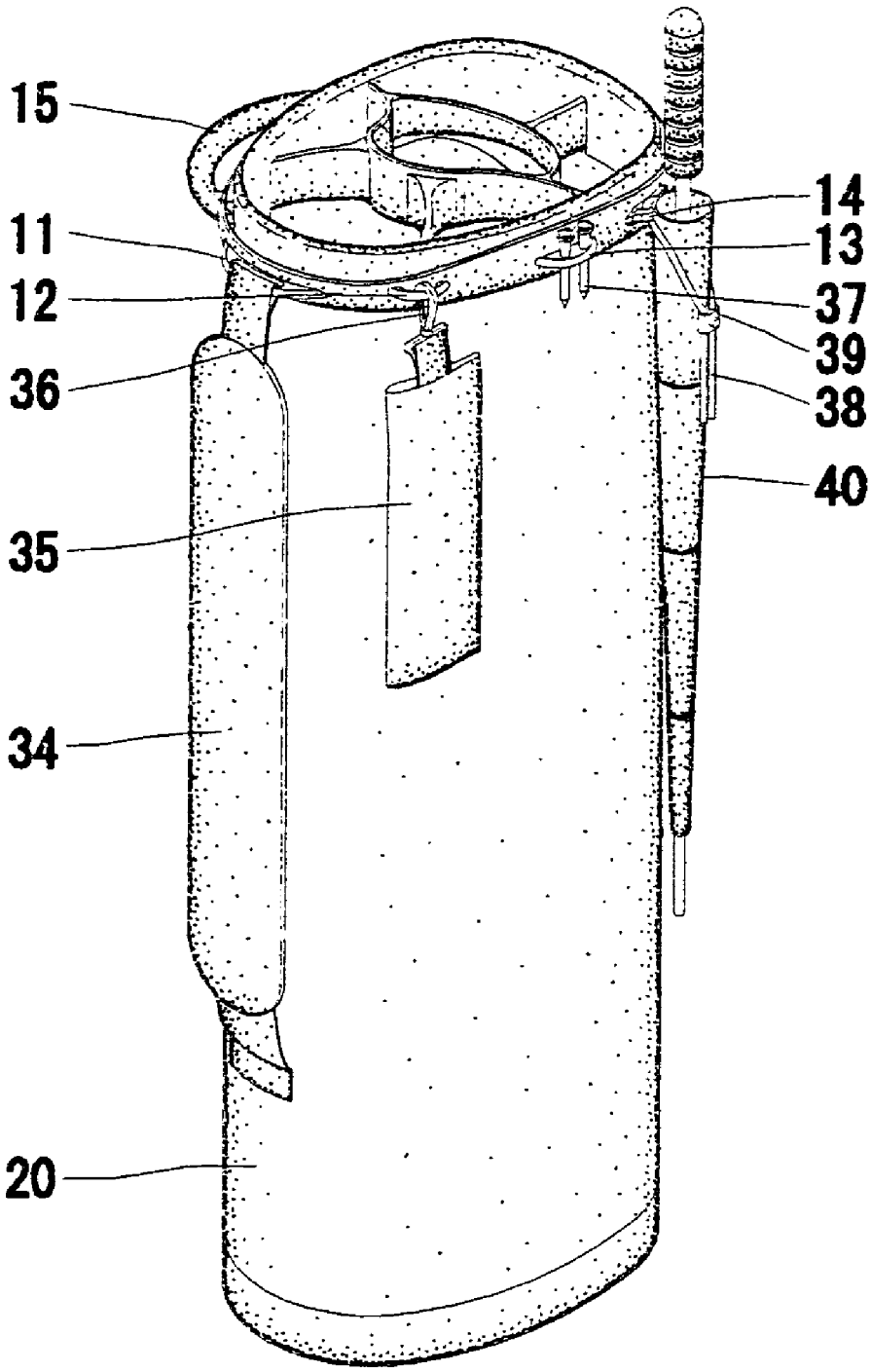
FIG. 5 is a perspective view of the club-bagging device of FIG. 1 to which a shoulder strap, a towel, a tie and two tees are attached.
Figure 6:
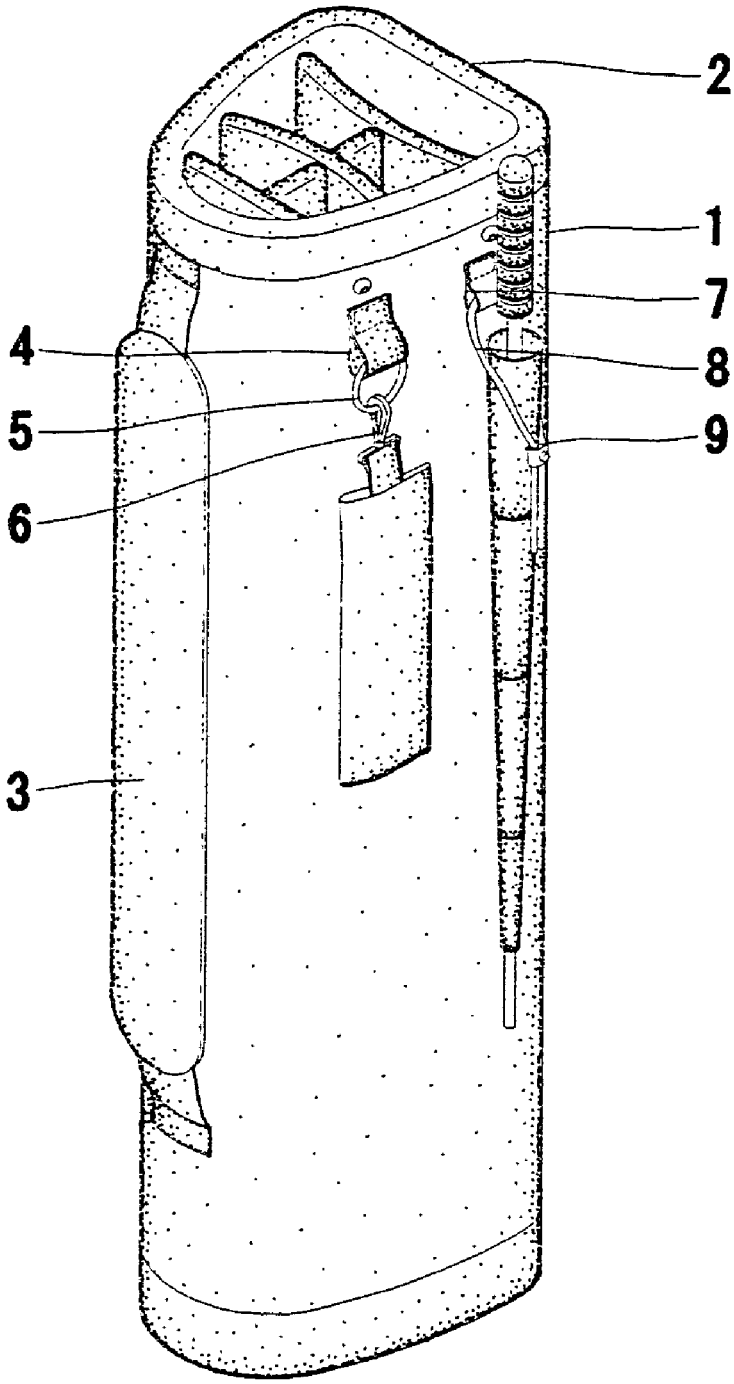
Fig. 6 PRIOR ART
FIG. 6 is a perspective view of a conventional club-bagging device on which a shoulder strap, a hook and a tie are sewn.

Referring to FIG. 5, a shoulder strap 34 includes a lower end and an upper end. The lower end of the shoulder strap 34 is sewed on the bag 20. The upper end of the shoulder strap 34 is inserted though a slot defined in the first lug 11 and sewn on another portion of the shoulder strap 34. Thus, the strap 34 is attached to the club-bagging device.

A towel 35 is connected with a hook 36. The hook 36 can be engaged with the second lug 12. Thus, the towel 35 is attached to the head frame 10 in a releasable manner.

Two tees 37 are inserted in two apertures defined in the third lug 13 so that the tees 37 are attached to the head frame 10 in a releasable manner.

A tie 38 includes two portions. The fourth lug 14 defines two apertures through each of which each of the portions of the tie 38 is inserted. A locking element 39 is installed on the portions of the tie 38. The tie 38 and the locking element 39 are used to hold an umbrella 40 for example.

Although the invention has been explained in relation to the preferred embodiment, modifications and variations can be made without departing from the spirit and scope of the invention as hereinafter claimed.

The invention claimed is:

1. A club-bagging device comprising:

a bag;

a head frame installed on the bag;

a handle integrally formed on and extending transversely outward from the head frame, with the handle having first and second ends integrally formed as a single piece at spaced locations on the head frame, with the handle being arcuate in shape between the first and second ends of a size adapted to receive a hand of a golfer gripping the handle, wherein the head frame includes a lower portion put in and attached to the bag and an upper portion on which the handle is integrally formed;

a cloth for concealing the head frame, wherein the cloth includes a first portion covering an external side of the head frame and a second portion covering an internal side of the head frame, wherein the first portion of the cloth defines at least one cutout for receiving the handle;

a first lug integrally formed on the head frame for carrying an article;

a second lug, a third lug and a fourth lug all integrally formed on the head frame; and a shoulder strap with a lower end attached to the bag and an upper end attached to the first lug.

2. The club-bagging device according to claim 1 wherein the upper end of the shoulder strap is inserted through a slot defined in the first lug and attached.

3. The club-bagging device according to claim 1 further comprising a tie for binding the article, and wherein the second lug defines two apertures through which the tie is inserted.

4. The club-bagging device according to claim 3 wherein the tie includes two portions to be tied around the article.

5. The club-bagging device according to claim 4 including a locking element installed on the portions of the tie.

6. The club-bagging device according to claim 1 wherein the first lug is integrally formed on the head frame from a same material by molding of the head frame.

7. The club-bagging device according to claim 1 wherein the handle is integrally formed from a same material by molding of the head frame.

8. The club-bagging device according to claim 1 wherein the second lug is for engagement with a hook to which a towel is connected.

9. The club-bagging device according to claim 8 wherein the third lug defines at least one aperture for receiving a tee.

10. The club-bagging device according to claim 9 further comprising a tie for binding the article, and wherein the fourth lug defines two apertures through which the tie is inserted.

11. The club-bagging device according to claim 10 wherein the first portion of the cloth defines first, second, third and fourth cutouts for receiving the first, second, third and fourth lugs, respectively.

12. A club-bagging device comprising:

a bag;

a head frame installed on the bag;

a handle integrally formed on and extending transversely outward from the head frame, with the handle having first and second ends integrally formed as a single piece at spaced locations on the head frame, with the handle being arcuate in shape between the first and second ends of a size adapted to receive a hand of a golfer gripping the handle, wherein the head frame includes a lower portion put in and attached to the bag and an upper portion on which the handle is integrally formed;

a cloth for concealing the head frame, wherein the cloth includes a first portion covering an external side of the head frame and a second portion covering an internal side of the head frame, wherein the first portion of the cloth defines at least one cutout for receiving the handle;

a first lug integrally formed on the head frame for carrying an article;

a second lug, a third lug and a fourth lug all integrally formed on the head frame; and a tie attached to the fourth lug for binding the article, wherein the tie includes two portions to be tied around the article, wherein the fourth lug defines two apertures through each of which each of the portions of the tie is inserted.

13. The club-bagging device according to claim 12 wherein the second lug is for engagement with a hook to which a towel is connected.

14. The club-bagging device according to claim 12 wherein the third lug defines at least one aperture for receiving a tee.

15. The club-bagging device according to claim 12 including a locking element installed on the portions of the tie.

* * * * *